United States Patent [19]

Friedman

[11] Patent Number: 4,630,763

[45] Date of Patent: Dec. 23, 1986

[54] APPARATUS FOR SUPPORTING THE WEIGHT OF A BANJO IN ADJUSTABLE PROPORTIONS FROM BOTH THE TORSO AND THE SHOULDERS OF A PLAYER

[76] Inventor: Daniel J. Friedman, 8960 Cynthia St. #201, West Hollywood, Calif. 90069

[21] Appl. No.: 738,449

[22] Filed: May 28, 1985

[51] Int. Cl.[4] ..... A45F 3/04

[52] U.S. Cl. ..... 224/259; 224/215; 224/910

[58] Field of Search ..... 224/204, 211, 215, 216, 224/259, 209, 908, 909, 910

[56] References Cited

U.S. PATENT DOCUMENTS

| | | | |
|---|---|---|---|
| 2,996,228 | 8/1961 | Bauman | 224/259 |
| 3,357,613 | 12/1967 | Chase | 224/209 |
| 4,320,863 | 3/1982 | Lyer et al. | 224/908 |

*Primary Examiner*—Stephen Marcus
*Assistant Examiner*—David Voorhees
*Attorney, Agent, or Firm*—Romny Golant Martin Seldon & Ashen

[57] ABSTRACT

One strap supports a fraction of the banjo weight from the banjo player's waist or hips. This strap is attached to the banjo at the two sides of the banjo resonator and passes around the player's torso. Two other straps support the remainder of the banjo weight from the player's shoulders. The weight carried by the shoulders is distributed in approximately equal fractions between the two shoulders. The shoulder straps are coupled in common to the top of the banjo resonator, pass respectively over the player's two shoulders and behind the player's back, and are there connected together. Two additional features are provided to permit the player to adjust the distribution of weight as between the player's torso and shoulders: (1) the torso strap and the shoulder straps are interconnected behind the player's back, and (2) the connection between the shoulder straps and the top of the resonator is through an adjustable linkage. The player controls the weight distribution by adjusting the linkage.

3 Claims, 5 Drawing Figures

APPARATUS FOR SUPPORTING THE WEIGHT OF A BANJO IN ADJUSTABLE PROPORTIONS FROM BOTH THE TORSO AND THE SHOULDERS OF A PLAYER

BACKGROUND

1. Field of the Invention

This invention relates generally to apparatus for supporting a banjo from a player's body, and more particularly to an apparatus for supporting and distributing the weight of a banjo from both the torso and the shoulders of a banjo player in adjustable proportion.

2. Prior Art

Prior devices for supporting a banjo from the banjo player's body generally consist of a single strap that passes over one shoulder of the musician. The two ends of the strap are connected respectively to the top and bottom of the banjo resonator.

Such devices are most unsatisfactory in use because a banjo is quite heavy and the weight on the player's shoulder soon becomes uncomfortable and fatiguing. Banjo players are usually called upon to stand while performing, and such performances typically last three hours or more. Hence the problem of discomfort and fatigue is very significant.

The directly relevant prior art thus fails to provide any relief to banjo players, who are constantly shifting the shoulder strap from one position to another and never really comfortable.

Due to the unique character of the banjo, devices for supporting other types of instruments—and for supporting other types of equipment in general—are of questionable relevance. In the absence of significant prior art directly related to the field of my invention, however, I shall discuss below some support devices in these other fields.

Known devices for supporting the weight of a musical instrument from the body of a person playing the instrument include those described in U.S. Pat. Nos. 4,254,901 to McIntosh, 3,102,446 to Raleigh, and 4,226,161 to Goetsch. Another possibly relevant device, though it is not even for supporting a musical instrument at all, is described in U.S. Pat. No. 3,152,738 to Worsfold; his device is for holding a camera.

McIntosh discloses a combination of straps for supporting a guitar in approximately equal weight proportions from the player's two shoulders. This system includes two straps passing over the player's shoulders and coming together in front of the player's torso at a point immediately atop the guitar body. The two straps are interconnected behind the player's back, and from this interconnection point a strap passes around one side of the player's body to a suspension peg at the bottom end of the guitar. McIntosh explains that this latter strap is provided for the purpose of "additional stability"; thus it apparently bears no significant fraction of the weight of the guitar.

Raleigh, on the other hand, shows a single waist-encircling belt for an electric guitar. His belt "removes the instrument's weight from the player's neck" and "permits the instrument's weight to be carried at the waist of the musician." He does not suggest that it would be desirable to suspend any of the weight of the guitar from the player's neck or shoulders.

Analogously Goetsch describes a combination of straps for supporting an accordion from the player's waist, and in particular for minimizing the weight of the accordion on the player's shoulders. His system includes one strap connected at the two sides of the accordion, near the bottom of the instrument, and passing around the accordion player's waist or hips.

Goetsch also provides a pair of shoulder straps, each connected to the accordion at two points. The left shoulder strap is connected to the accordion at the top left corner of the treble section of the instrument, passes over the player's left shoulder, and apparently (though the drawings are unclear in this regard) is connected to the accordion partway down the back of the left edge of the treble section. Similarly the right shoulder strap is connected to the accordion a few inches to the right of the top left corner of the treble section, passes over the player's right shoulder, and apparently is connected to the instrument partway down the back of the treble section.

Goetsch's shoulder straps are provided solely to "stabilize [the] accordion . . . in front of [the] musician"—whereas the waist strap "transfers the weight of [the] accordion . . . to the musician's waist thereby relieving substantially all of the weight of the accordion from [the] shoulder straps . . . " None of the straps in Goetsch is interconnected to any of the other straps.

None of the devices discussed above supports an instrument from both the torso and the shoulders. None is designed to let the user shift any of the weight from torso to shoulders or vice versa.

At first glance, Worsfold's camera straps may appear to be sharing the weight of his camera adjustably between the upper and lower straps. Worsfold describes adjustment of the tension of his straps by means of the "slidable adjusters". But careful study of Worsfold's disclosure reveals that there is no significant adjustability of weight distribution, and indeed bearing the weight of a camera is not the thrust of Worsfold's invention.

In fact the weight of a camera is quite inconsequential, and the purpose of Worsfold's invention is not weight distribution but rather convenience. He sets out to obviate the dilemma of people engaging in an activity such as hunting, fishing, hiking or sailing, as they try to "grasp the instrument in one or both hands . . . without interfering with such activity and risking possible serious injury to the instrument [i.e., camera]."

Worsfold therefore uses elastic straps, to resiliently secure the camera firmly against the user's chest. Consequently Worsfold's adjustments are only for the purpose of obtaining a desired firmness of tensioning of the camera against the chest.

Moreover, the thrust of Worsfold's innovation does not even go to tensioning a camera in place against the chest while the camera is in use. His invention holds the camera in place when the camera is not in use. When the user wishes to actually use the camera, the user moves it into an entirely different position against the forehead or at the waist, by pulling against the tension of the elastic.

If elastic straps were used to support a banjo in playing position during use of the banjo, the banjo either would be held too tightly against the musician's body or would extend the elastic fully so that the resiliency would serve no useful purpose. In fact, I have experimented with elastic straps and found them very unsatisfactory. Worsfold, like the musical-instrument supports discussed earlier, does not teach or even suggest any system for distributing the weight of a heavy instrument to minimize discomfort and fatigue during protracted use.

SUMMARY OF THE DISCLOSURE

My invention is an apparatus for supporting and distributing the weight of a banjo in playing position from both the waist or hips and the shoulders of a banjo player, in adjustable proportion.

The invention includes, first, some means for supporting a fraction of the banjo weight from the player's waist or hips while the banjo is in use. To distinguish these first means from other features of the invention, in general terms these first means may be called "first strap means". The first strap means are substantially nonresilient, and they serve to support a first fraction of the banjo weight that is significant—unlike, for example, the bottom rear strap of McIntosh.

The first strap means are connected to two separated points at respective sides of the banjo body, and they pass substantially around the player's waist or hips and behind the player's back.

The invention also includes some means for supporting a fraction of the banjo weight from the player's shoulders while the banjo is in use. These means may be called "second strap means". They too are substantially nonresilient, and they too serve to support a second fraction of the weight that is also significant—unlike, for example, the shoulder straps of Goetsch.

The second strap means support this second fraction approximately equally from the player's two shoulders. These second strap means are connected near the top of the banjo body, and pass over the musician's shoulders and behind her or his back.

My invention also includes some means for controlling, while the banjo is in use, the relative size of the first and second banjo-weight fractions mentioned above. These means may be called "weight-distribution means". No such feature in any form appears in any of the patents discussed above.

The weight distribution means advantageously include an interconnection, behind the player's back, between the first and second strap means. This interconnection ensures sharing the weight of the instrument as between the waist and shoulders—as distinguished from the back of the user's neck.

Preferably the weight-distribution means are freely adjustable by the user, without removing the banjo from the user's body, to vary the relative size of the first and second fractions. To this end the weight-distribution means advantageously also include an adjustable linkage that is associated with the second strap means. This linkage serves to control the height of the banjo relative to the player's shoulders. By adjusting the linkage to vary the height, the user can vary the relative size of the first and second fractions.

All of the foregoing operational principles and advantages of the present invention will be more fully appreciated upon consideration of the following detailed description, with reference to the appended drawings, of which:

DETAILED DISCUSSION OF THE PREFERRED EMBODIMENT

Figure 1:
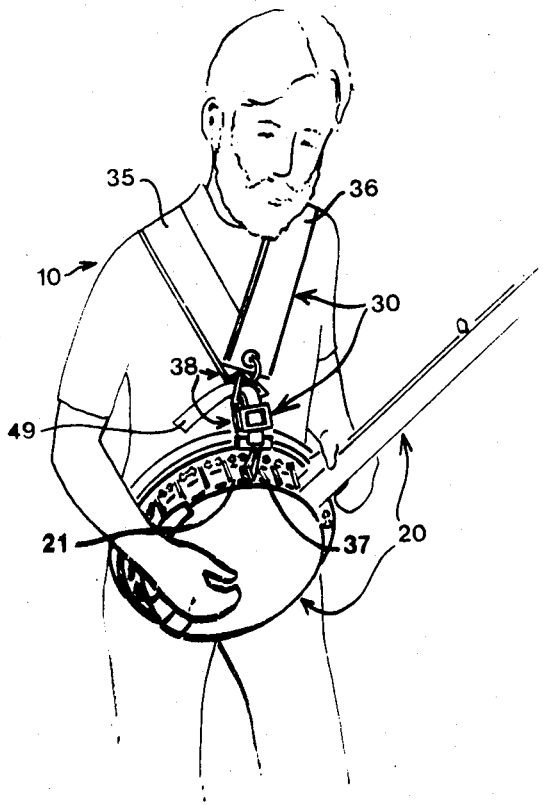
FIG. 1 is a generally front elevation or perspective view of a musician using a preferred embodiment of my invention to support a banjo in playing position during use.
Figure 2:
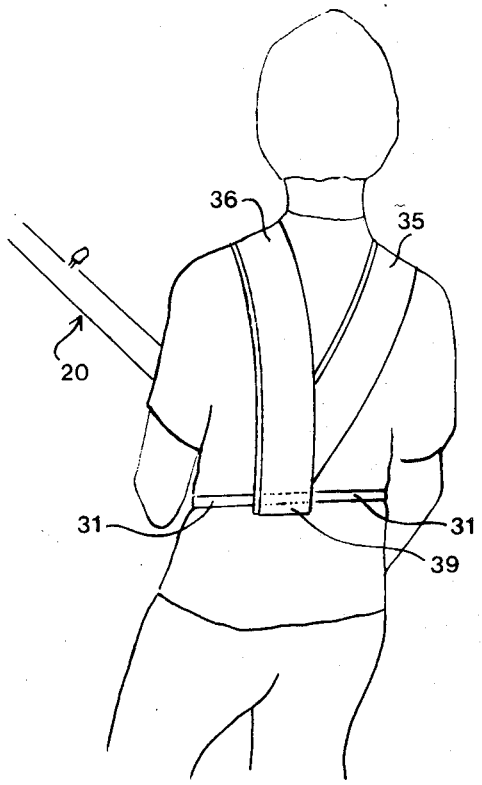
FIG. 2 is a similar rear elevation or perspective view of the FIG. 1 musician, invention, and banjo.
Figure 3:
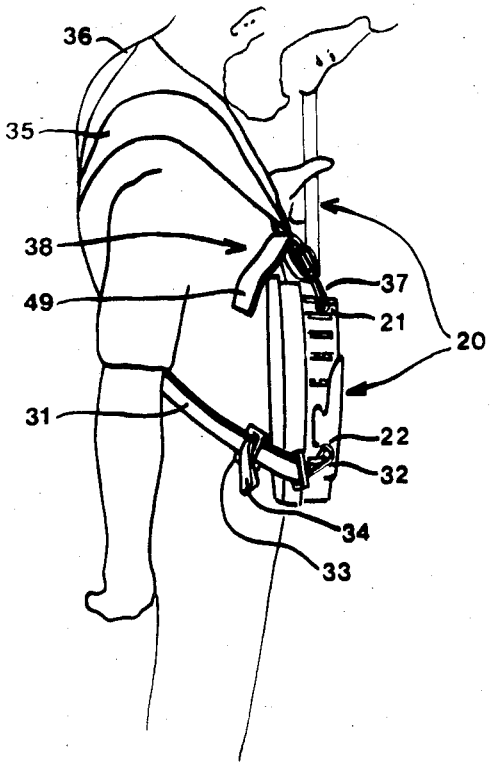
FIG. 3 is a right side elevation or perspective view of the FIG. 1 musician, invention, and banjo, taken from slightly above the musician's head and at an angle of about thirty degrees to the horizontal.

As shown in FIGS. 1 through 3, a preferred embodiment of my invention is used by a musician 10 to support a banjo 20 in playing position while the musician is actually playing the banjo.

The first strap means 31 (FIGS. 2 and 3) generally pass behind the musician's back and are attached at a point 22 on the right side of the banjo resonator by means of a conventional clip 32 or the like. A special ring may be provided on the banjo to facilitate this attachment, or the clip simply may be attached to one of the tension rods at the side of the banjo.

Figure 5:
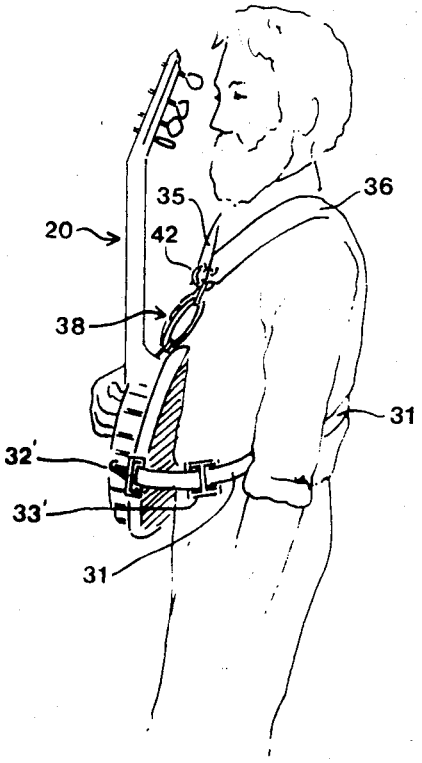
FIG. 5 is a left elevation complementing FIG. 2.

The first strap means 31 are also similarly attached at approximately the opposite point (as illustrated in FIG. 5) on the left side of the resonator, by a similar clip 32' or the like. At one side or the other, or both sides if preferred, the first strap means 31 may be made adjustable in length by passing the free end 34 of the strap means 31 through a buckle 33.

The second strap means 35, 36 are connected at a point 21 near the top of the banjo resonator or body, through the intermediary of a clip 37 and an adjustable linkage 38. As seen from the front of the musician's body in FIG. 1, the second strap means include individual straps 35 and 36 that pass over the musician's two shoulders respectively, and behind the musician's back. As is clear from FIG. 2, however, for ease of construction these straps may be provided in the form of a single long strap 35–36 that passes over one shoulder, down toward the small of the musician's back, and then back up over the other shoulder.

Essential to my invention are suitable weight-distribution means for controlling the relative size of the first and second fractions of the banjo weight. The weight-distribution means include an interconnection 39, in back of the musician's body, between the first strap means 31 and the second strap means 35, 36.

The interconnection 39 is advantageously formed by passing the first strap means 31 through a loop in the second strap means 35, 36.

I prefer to fix such a loop in position along the second strap means 35, 36, by sewing the second strap means 35, 36 together near their lowermost point. This is not absolutely necessary, but preferable because it makes the assemblage of straps easier for the musician to put on and take off.

The weight-distribution means also include the intermediary linkage 38 in front of the musician's body. As previously mentioned this linkage is preferably adjustable, so that the weight-distribution means can control the proportions of weight adjustably as between the waist or hips and the shoulders.

Figure 4:
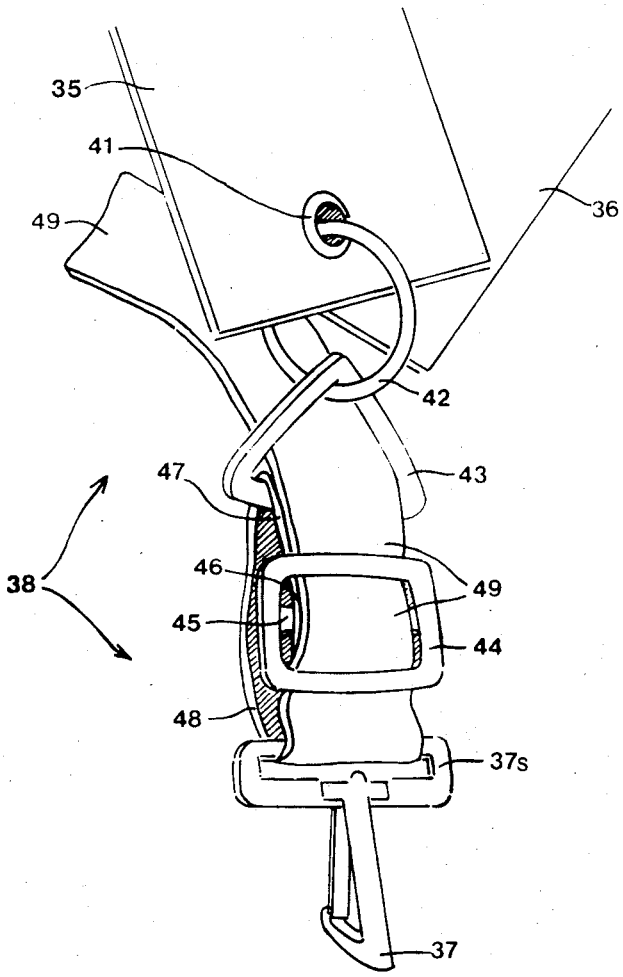
FIG. 4 is a close-up or detailed frontal elevation of the adjustable linkage used in the FIG. 1 embodiment.

FIG. 4 illustrates an arrangement which I have found very convenient and otherwise satisfactory for making the intermediary linkage adjustable. First, a hole is made near the front end of each strap 35, 36, and the hole is protected by a grommet 41. A lightweight circular plastic or metal ring 42 passes through both grommeted holes and through an open plastic or metal triangle 43.

The ring 42 and triangle 43 provide a freely rotatable connection point in front of the musician's body, so that the top of the instrument has substantial mobility relative to the player—and also so that there is a minimal amount of binding that could otherwise interfere with the free equalization of weight as between the shoulders.

Also part of the adjustable linkage 38 is a buckle 44 with a central crossbar 45. A short strap 46–47–48–49 is sewn into a loop 46 that encircles the crossbar 45, securing the short strap to the buckle 45. From the loop 46 the strap extends upwardly as at 47 and then rearwardly (toward the musician's body) through the triangle 43. The short strap continues downwardly as at 48 and then forwardly through the slot portion 37*s* of the clip 37.

Finally the free end 49 of the short strap passes upwardly through the buckle 44 in the usual fashion of a belt through a belt buckle, and rearwardly through the triangle 43, any excess length being allowed to dangle freely as suggested in FIGS. 1 and 3.

The short strap 46–47–48–49 and the buckle 44, 45 advantageously are made of suitable materials and are suitably dimensioned for frictional engagement sufficient to support the banjo. This type of buckle may be replaced by a buckle with a tongue that extends through any one of several holes spaced along the short strap in the region 49—again in the manner of a conventional belt with a belt buckle. In my experience, however, the frictional system is preferred since less fussing with the linkage is required to make adjustments, and finer adjustments may be obtained.

It is to be understood that all of the foregoing detailed descriptions are by way of example only, and not to be taken as limiting the scope of my invention—which is expressed only in the appended claims.

I claim:

1. Apparatus for supporting and distributing the weight of a banjo, in playing position, from both the waist or hips and the shoulders of a banjo player in adjustable proportion, comprising:

first substantially nonresilient dual strap means for supporting a first significant fraction of such banjo weight from such palyer's waist or hips while the banjo is in use, said first strap means being connected to two separated points at respective sides of the banjo body and passing substantially around such player's waist or hips and behind such player's back;

second substantially nonresilient strap means for supporting a second significant fraction of such banjo weight from such player's two shoulders approximately equally while the banjo is in use, said second strap means being connected near the top of the banjo body remote from both of said two separated points and passing over such player's shoulders and behind such player's back; and weight-distribution means for controlling the relative size of said first and second fractions of such banjo weight while the banjo is in use; and wherein:

said second strap means are connected to the top of the banjo body through the weight-distribution means, and comprise:

separate left and right shoulder straps secured together at a junction in front of such player's torso, and a connector depending from said junction of the left and right shoulder straps;

said weight-distribution means comprise an adjustable linkage, depending from the connector and connected to the top of the banjo body at substantially only a single point, for controlling tension in the shoulder straps; and adjustment of the linkage varies the relative size of said first and second fractions controllably.

2. The apparatus of claim 1, wherein:

the weight-distribution means control the relative size of said first and second fractions adjustably.

3. The apparatus of claim 1, wherein the connector is readily rotatable.

* * * * *